United States Patent [19]

Bichet

[11] 4,338,696

[45] Jul. 13, 1982

[54] APPARATUS FOR SHAPING COUNTERS IN MAKING SHOES

[75] Inventor: Lucien Bichet, Draveil, France

[73] Assignee: Societe Immobiliere et Financiere Suchet-Alfort (S.I.F.S.A.), Maisons Alfort, France

[21] Appl. No.: 174,654

[22] Filed: Aug. 1, 1980

[30] Foreign Application Priority Data

Aug. 3, 1979 [FR] France ..... 79 19929

[51] Int. Cl.[3] ..... A43D 11/00

[52] U.S. Cl. ..... 12/54.3; 12/53.5

[58] Field of Search ..... 12/54.3, 54.2, 53.5

[56] References Cited

U.S. PATENT DOCUMENTS

| | | | |
|---|---|---|---|
| 3,238,545 | 3/1966 | Stambaugh et al. | 12/54.3 |
| 3,545,023 | 12/1970 | Foss et al. | 12/54.3 |
| 3,775,796 | 12/1973 | Schindler et al. | 12/54.3 |
| 3,977,033 | 8/1976 | Tabroff | 12/54.3 |

*Primary Examiner*—Patrick D. Lawson

*Attorney, Agent, or Firm*—Browdy and Neimark

[57] ABSTRACT

An apparatus for shaping the counters of shoe uppers is of the type which includes, on higher portions of the same frame or framework, two heating stations for heating portions of the upper, reactivating glue for assembly of the shoe uppers. In lower portions of the apparatus, two shaping stations for shaping the counters, which are made of a preform, comprise a last and shaper able to engage with one another to clamp the shoe upper tightly. The apparatus is provided with instrumentalities allowing each shaping station to operate in three stages; namely, (a) holding of the shoe piece on the last and fitting it to the height of the shoe upper, (b) positioning of the piece by holding of the preform shaper on the shoe upper at slight pressure, and then (c) properly shaping by clamping of the shoe upper between the shaper and last under a rather high pressure of 5 to 6 kg/cm$^2$.

8 Claims, 5 Drawing Figures

APPARATUS FOR SHAPING COUNTERS IN MAKING SHOES

BACKGROUND OF THE INVENTION

This invention relates to the field of apparatus intended to pre-bend the counters of shoes during the manufacture thereof, i.e., to give a quasi final shape to the back portions of shoes. The bending of the counters, which constitutes one of numerous steps in the process of making shoes is effected just before assembly of the toe portion of the shoes in a fabrication line. The invention relates more particularly to improvements made in known apparatus for shaping of counters.

In apparatus so far designed for shaping the back portion of a shoe, bending is performed using a shaper by introducing the back portion of the shoe, without its insole, on a metal last (or punch), then putting this last in contact with the shaper (or curved element) under pressure. Generally, the apparatus works by pairs of shoes and therefore is constituted by two shaping stations on the same frame. It is possible to provide, in the upper portion of the apparatus, two stations for heating the material which is to form the respective counters, activating glue if present on one of the elements of the shoe. The two shaping stations are conveniently positioned below the respective heating stations.

In apparatus of the above-described type, safety problems arise because manual placing of the shoe elements on the respective lasts and the very rapid pressing which follows virtually immediately during the shaping operation, which is effected in a single phase. Further, if the shoe element has been poorly positioned on the metal last or if it moves after it has been placed on the last, the bending is not suitable and the shoe preform must be discarded.

SUMMARY OF THE INVENTION

The present invention aims at obviating the above-mentioned drawbacks.

Suitable techniques for placing of the shoe element, a correct positioning of this element on the preform last and a shaping operation in total safety is provided. The control of each phase being is arranged so that, while achieving a gain in time, the operator cannot make a false move.

To solve the above-discussed problems, the principal aim, as well as others which are to become apparent from the text below, the apparatus according to the invention, in use, is provided with means allowing each shaping station to work successively in three stages, namely: (a) holding of a shoe piece on the last (or punch) and fitting the piece to the height of the shoe upper; (b) positioning of the piece by holding of the preform shaper on the upper at a slight pressure, and then (c) properly shaping by clamping of the upper between the last and preform shaper index a rather higher pressure of 5 to 6 kg/cm$^2$.

To assure holding of the shoe upper on the last with proper regulation of the height of the shoe upper, the apparatus is provided, above and on a side of each of the two shaper units of a type known per se with an arm provided, near one end, with a pin able to come adapted to reset on the top of the last and, near its other end, with a stop corresponding to the height of the shoe upper and which, in operation, is moved to be contiguous with and flat against the upper edge of this latter. This positioning of the shoe upper is maintained during above-mentioned phases (b) and (c) of the shaping operation.

According to another characteristic of the invention, the apparatus is provided with a two-phase foot control making it possible to assure successively the coming together of the shaper and the last and then the clamping of the counter of the shoe upper under great pressure.

BRIEF DESCRIPTION OF THE DRAWINGS

The invention will be better understood from the detailed description of a non-limiting embodiment set out below, with reference to the accompanying drawings.

DETAILED DESCRIPTION OF THE PREFERRED EMBODIMENT

Figure 1:
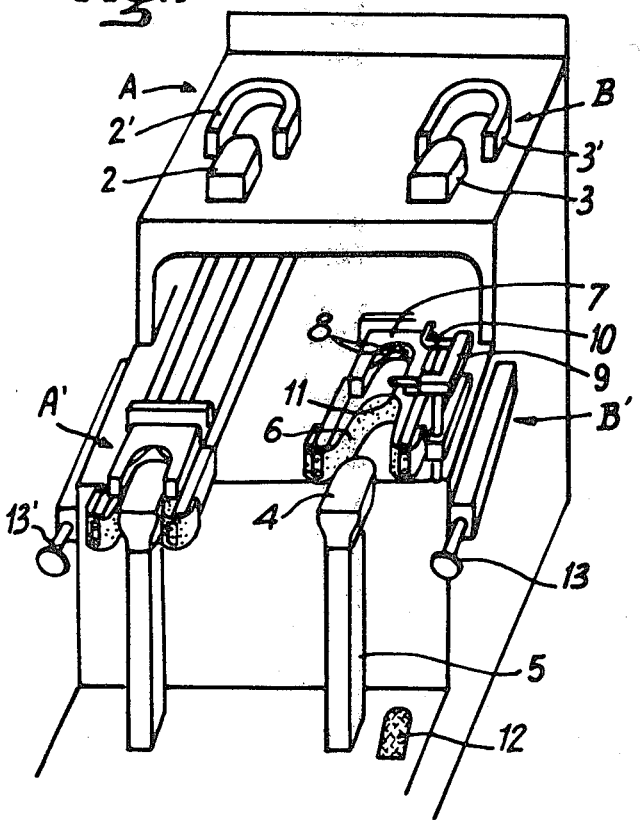
FIG. 1 is a simplified view in persective of a double-station apparatus for shaping counters in making shoes according to the invention.
Figure 2:
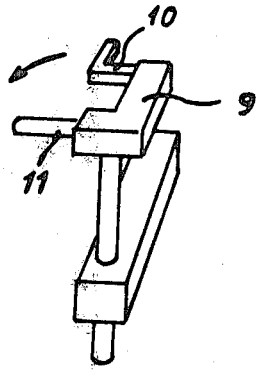
FIG. 2 is a perspective view showing details of the device for holding the shoe upper on the last and of the upper height stop associated therewith which can be used as part of the apparatus shown in FIG. 1.
Figure 3A:
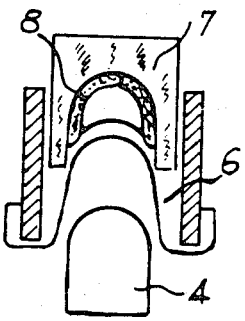
FIGS. 3*a* to 3*c* are illustrative plan views of the last and shaping operation according to different phases thereof.
Figure 3B:
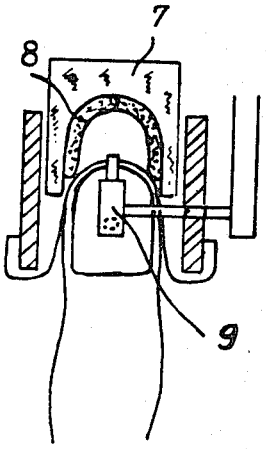
Figure 3C:
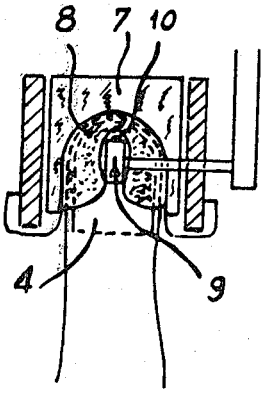

In the illustrative embodiment shown in FIG. 1, the apparatus includes two work stations A,A′ and B,B′ for preparing and shaping of uppers of a pair of shoes. According to the known technique, there is placed on a unified framework or frame on the upper portions thereof two systems generally designated A and B for preheating material which are to constitute the shoe uppers. Elements, which are to be shaped, are introduced between respective lasts 2,2′ and corresponding heating elements 3,3′. The lower part is provided with a pair of shaping stations A′,B′ for shaping properly the counters of a pair of shoes during the manufacturing thereof. These two stations are of the same design and work in turn, hence the staggered representation in time in the instrumentalities constituting the stations A′ and B′. Each of the shaping stations A′ and B′ essentially include, referring to the lower right portion of FIG. 1, a last 4 on which the back of the shoe to be shaped will be placed; it will be noted, in this connection, that on the one hand, the apparatus of the invention can work on a shoe upper with an separated back or on a shoe provided with an insole. The last 4 is extended downward on a spar 5 which is of sufficient length and is shaped to enable one to use the apparatus in the making of boots.

A shaper 6, which can be conventionally made of silicone resin, corresponding to the shape of the back of the shoe is provided. A translation carriage 7 carries clamps 8, which serve to clamps flaps of the counter of the shoe upper tightly on the last. An arm 9, articulated and hinged, is provided with a stop 10 at the level of the height of the upper of the shoe and with a stop 11 for positioning the counter of the shoe, with or without its inner sole on the last 4. For the sake of succinctiness, the elements of the left-hand station A′ have not been numbered, these parts corresponding to those of the right-hand station B′ and those parts corresponding to the arm 9, the stop 10 and the stop 11 are not shown in the left-hand station. It is to be understood, of course, that such elements are to be present.

The apparatus includes a two-phase foot control which includes a single foot-operated pedal 12 (one per machine) and two hand-operated two push buttons 13 and 13' for manual control, one of the push buttons being associated with the left-hand station, and the other being associated with the right-hand station.

The controls of the operating phases are pneumatic and have been provided in a distinct manner. Actually, during the first two steps (a) and (b) of operation of the apparatus, the operator needs his hands to put the shoe upper on the last 4 and therefore can conveniently use the control pedal 12; then, for the third step (c), the most delicate phase, the operator is able to operate one or the other of the push buttons 13 and 13' manually depending on whether he is working on a left or right upper. A separation of the control function particularly improves personal safety, the high pressure not being applied until the operator pushes one of the push-buttons 13,13' with his hand, assuring that this hand will not be caught between the last 4 and shaper 6 or the shaper 6 and the carriage 7. The functioning of the bending shaper is illustrated in the simplified drawings of FIGS. *3a–3c*. FIG. *3a* illustrates the bending shaper in a waiting or rest position, the arm 9 (not shown) being lifted.

In a first step (not shown in the drawings), the operator places the back or counter of the shoe or boot upper on the last 4 then he presses on pedal 12 (with two phase functioning), the arm 9 is then brought down on the punch 4, the pin 11 holding the shoe upper in position on the punch 4, while the stop 10 rests on the upper edge of the shoe upper.

In a second step, which is initiated by pressing on the pdeal 12 to the end of its possible travel, and which is illustrated in FIG. *3b*, the clamp-carrying carriage 7 moves toward the last 4 and the clamps 8 hold the shoe upper under moderate or slight pressure, on the order of 2 kg/cm$^2$, during this phase of positioning the arm 9 is down and the stops 10 and 11 rest on the shoe piece.

Finally, in a third step, the operator manually presses on the control button 13 to initiate the bending and shaping operation, during which the clamps 8, working with the shaper 6 by advance of the carriage 7, tightly clamp the shoe upper under a pressure of about 5 to 6 kg/cm$^2$ between the shaper 7 and the last 4. During this shoe counter shaping operation, the arm 9 is always kept in rest position as in the previous phase.

After a timed delay in the bending and shaping operation, the shaping unit formed by the members 6, 7 and 8 is released from the last 4 and the arm 9 is lifted. The cycle begins again as indicated above for the first phase. As in known apparatus, the last 4 is or may be cooled. In machines working by pairs of shoes, as shown in FIG. 1, the three operations (a), (b) and (c) are staggered for the shaping stations A' and B'. For example, when the shaping station B' is in at the third stage, the shaping station A' is at the dead point, the arm associated with station being lifted; when station B' is at the first stage, station A' is at the third position, and so on. Of course, the invention is not limited to the emodiment described above and extends to equivalent structures and types of functioning.

What is claimed is:

1. In an apparatus for bending and shaping counters in the course of manufacturing shoes and which includes at least one preform shaper and at least one last operatively positioned and arranged to engage one another and clamp a shoe piece, which is to be formed into a shoe upper, tightly therebetween, the improvement comprising means for initially holding a shoe piece on said last and fitting it to a given height of a shoe upper, means for positioning the shoe piece including means for holding said preform shaper on the shoe piece under a slight pressure; and means for bending and shaping the shoe piece into a shoe upper by applying a pressure of from about 5 kg/cm$^2$ to about 6 kg/cm$^2$ to the shoe piece between said last and said shaper, wherein said means for initially holding and positioning a shoe piece on said last includes first stop means in form of a pin operatively positioned to come to rest on said last and second stop means operatively positioned to define the height of an upper and to come rest on an edge of a shoe piece when it is fit on said last.

2. An improved apparatus in accordance with claim 1, including a foot pedal having two distinct pressed positions, wherein said means for initially holding and said means for positioning said preform shaper under slight pressure are responsive to a first pressed position of said foot pedal, and wherein said means for bending and shaping the shoe piece is responsive to a second position of said foot pedal.

3. In an apparatus according to claim 1, at least one heating station positioned above said at least one preform station for heating the shoe piece and to activate glue if present thereon.

4. In an apparatus according to claim 1, including additionally a further preform shaper and a further last operatively positioned and arranged to engage one another and clamp a second shoe piece which is to be formed into a second shoe upper tightly therebetween; further means for initially holding a second shoe piece on said further last and fitting to a given height of a second shoe upper; means for positioning the second shoe piece including means for holding said further preform shaper on the second shoe piece under a slight pressure; and means for bending and shaping the second shoe piece into a second shoe upper by applying a pressure of from about 5 kg/cm$^2$ to about 6 kg/cm$^2$ to the second shoe piece between said further last and said further shaper.

5. In an apparatus for bending and shaping counters in the course of manufacturing shoes and which includes at least one preform shaper and at least one last operatively position and arranged to engage one another and clamp a shoe piece, which is to beformed into a shoe upper, tightly therebetween, the improvement comprising means for initially holding a shoe piece on said last and fitting it to a given height of a shoe upper; means for positioning the shoe piece including means for holding said preform shaper on the shoe piece under a slight pressure; and means for bending and shaping the shoe piece into a shoe upper by applying a pressure of from about 5 kg/cm$^2$ to about 6 kg/cm$^2$ to the shoe piece between said last and said shaper including additionally a further preform shaper and a further last operatively positioned and arranged to engage one another and clamp a second shoe piece which is to be formed into a second shoe upper tightly therebetween; further means for initially holding a second shoe piece on said further last and fitting to a given height of a second shoe upper; means for positioning the second shoe piece including means for holding said further preform shaper on the second shoe piece under a slight pressure; and means for bending and shaping the second shoe piece into a second shoe upper by applying a pressure of from about 5 kg/cm$^2$ to about 6 kg/cm$^2$ to the second shoe piece between said further last and said further shaper.

6. An improved apparatus according to claim 4 or claim 5, wherein said further means for initially holding and positioning a second shoe piece on said further last includes further first stop means in form of a second pin operatively positioned to come to rest on said further last and second stop means operatively positioned to define the height of an upper and come to rest on an edge of a second shoe piece when it is fit on said further last.

7. In an apparatus according to claim 6, including a further heating station positioned above said further preform station for heating the second shoe piece and to activate glue if present thereon.

8. In an apparatus according to claim 4 or claim 5, including a further heating station positioned above said further preform station for heating the second shoe piece and to activate glue if present thereon.

* * * * *